US012320257B2

(12) United States Patent
Carr et al.

(10) Patent No.: US 12,320,257 B2
(45) Date of Patent: Jun. 3, 2025

(54) SYSTEM AND METHOD FOR STABILIZING A MINE

(71) Applicant: Drill Tech Drilling & Shoring, Inc., Antioch, CA (US)

(72) Inventors: Patrick Hugh Carr, Kansas City, KS (US); Clay Robert Rathbun, Westwood, KS (US)

(73) Assignee: DRILL TECH DRILLING & SHORING, INC., Antioch, CA (US)

( * ) Notice: Subject to any disclaimer, the term of this patent is extended or adjusted under 35 U.S.C. 154(b) by 191 days.

(21) Appl. No.: 18/046,335

(22) Filed: Oct. 13, 2022

(65) Prior Publication Data

US 2024/0125235 A1 Apr. 18, 2024

(51) Int. Cl.
*E21F 15/06* (2006.01)
*E21F 15/00* (2006.01)

(52) U.S. Cl.
CPC ..... *E21F 15/06* (2013.01); *E21F 15/005* (2013.01)

(58) Field of Classification Search
CPC ..... E21F 15/06; E21F 15/005
See application file for complete search history.

(56) References Cited

FOREIGN PATENT DOCUMENTS

| | | | | |
|---|---|---|---|---|
| GB | 2395499 A | * | 5/2004 | ..... E02D 5/385 |
| SU | 1618895 A | * | 1/1991 | |
| SU | 1752988 A1 | * | 8/1992 | |

* cited by examiner

*Primary Examiner* — Janine M Kreck
(74) *Attorney, Agent, or Firm* — HOVEY WILLIAMS LLP

(57) ABSTRACT

An aggregate slinger for an underground void stabilization system, the aggregate slinger comprising a vertically extending shaft and a number of dispersing members. The vertically extending shaft is inserted through a ground hole into an underground void and rotated about a vertical axis in the ground hole. The dispersing members are configured to extend radially from a lower end of the vertically extending shaft in the underground void so that the dispersing members radially spread aggregate descending into the underground void from the ground hole to form a radially enlarged support column of aggregate in the underground void.

19 Claims, 11 Drawing Sheets

SYSTEM AND METHOD FOR STABILIZING A MINE

BACKGROUND

Stabilizing abandoned mines to allow surface development is a common practice. For example, creating support points in the center of mine rooms greatly increases the stability of the mine by reducing the span between the stone pillars left in place. Many abandoned mines are inaccessible due to safety, flooding, or closure of their access portals. For such cases, holes are drilled in the mines from the surface and grout (a fluid, self-leveling material) is pumped into the mines. This is an expensive process because of the large volumes of grout required.

SUMMARY

Embodiments of the present invention solve the above-mentioned problems and other related problems and provide a distinct advance in the art of mine stabilization. More particularly, the present invention provides mine stabilization systems that form a radially enlarged support column of aggregate in a mine.

An embodiment of the invention is a mine stabilization system broadly comprising a rotary machine including an aggregate slinger. The aggregate slinger is configured to spread the aggregate in a mine to form the support column and broadly comprises a vertically extending shaft, a bearing, and a number of dispersing members. The aggregate slinger is vertically suspended from the vertical telescoping column and configured to be lowered through a ground hole and at least partially into the mine.

The vertically extending shaft is supported on the vertical telescoping column and includes opposing upper and lower ends. The vertically extending shaft is drivably connected to a rotary motor near the upper end and is aligned in the ground hole via the bearing.

The bearing is positioned in the ground hole and configured to receive the vertically extending shaft. The bearing aligns and supports the vertically extending shaft in the ground hole. The bearing includes apertures or gaps for allowing aggregate to fall through or around the bearing.

The dispersing members are pivotably connected to the vertically extending shaft near the lower end via a hinge and are shiftable between a retracted position and a deployed position. The dispersing members 118 include plates or fins and lower and upper radially extending ribs. The lower radially extending rib is positioned on a bottom side of the plate and connects the plate to the hinge. The upper radially extending rib is positioned on an upper side of the plate. Each plate may be narrower near its proximal end and wider near its distal end. In this way, the plates can abut each other in the deployed position and have enough room between each other to shift to the retracted position. The radially oriented ribs are configured to urge aggregate radially outward as the vertically extending shaft rotates. The horizontal distance the aggregate can be distributed can be varied with the rotation speed of the aggregate slinger.

Another embodiment of the invention is a method of stabilizing a mine via a vibroflotation machine. The method forms a radially enlarged support column in the mine.

The method includes positioning a mine stabilization system near a ground hole above the mine with the vertically extending shaft of a vibroflotation tool aligned with the ground hole. The vibroflotation tool is then lowered down through the ground hole until a vibroflotation head of the vibroflotation tool is near a bottom of the mine.

A motor of the vibroflotation tool is then activated to vibrate the vibroflotation head. Aggregate is then dispensed into the ground hole and accumulates around the vibroflotation head. A waterjet system integrated with the vibroflotation tool also disperses water into the aggregate. The vibration of the vibroflotation head and the water then spreads the aggregate outward but also pack the aggregate to form a dense, radially enlarged support column.

The vibroflotation tool is then gradually raised upward in the mine to build up the radially enlarged support column and then through the ground hole as aggregate continues to be dropped into the ground hole. Continued vibration of the vibroflotation head and water dispersement causes aggregate to densely pack the ground hole.

Another embodiment of the invention is a mine stabilization system broadly comprising an aggregate slinger including dispersing links. The mine stabilization system may be used to reinforce an underground mine by forming a radially enlarged support column.

The aggregate slinger is configured to spread the aggregate in the mine to form the support column and broadly comprises a vertically extending shaft, a bearing, and a rotary head. The aggregate slinger is configured to be lowered through a ground hole and at least partially into the mine.

The vertically extending shaft is supported on the vertical telescoping column and includes opposing upper and lower ends. The vertically extending shaft is drivably connected to a rotary motor near the upper end and is aligned in the ground hole via the bearing.

The bearing is positioned in the ground hole and configured to receive the vertically extending shaft. The bearing aligns and supports the vertically extending shaft in the ground hole. The bearing includes apertures or gaps for allowing aggregate to fall through or around the bearing.

The rotary head includes pneumatic apertures and dispersing links. The rotary head may also be a bit having teeth for drilling the ground hole. Alternatively, the rotary head may be a toothless head to which the dispersing links are attached.

The pneumatic apertures are positioned around the rotary head for releasing pressurized gas (e.g., pressurized air) radially outward. To that end, the pneumatic apertures are fluidly linked to a pneumatic system configured to be extended down through the ground hole and activated to release the pressurized gas from the pneumatic apertures.

The dispersing links are chains, cables, wire, or the like connected at one end to a rotating body of the rotary head. The dispersing links are configured to hang downward when the rotary head is not spinning and extend radially outward due to centrifugal force when the rotary head is spinning.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
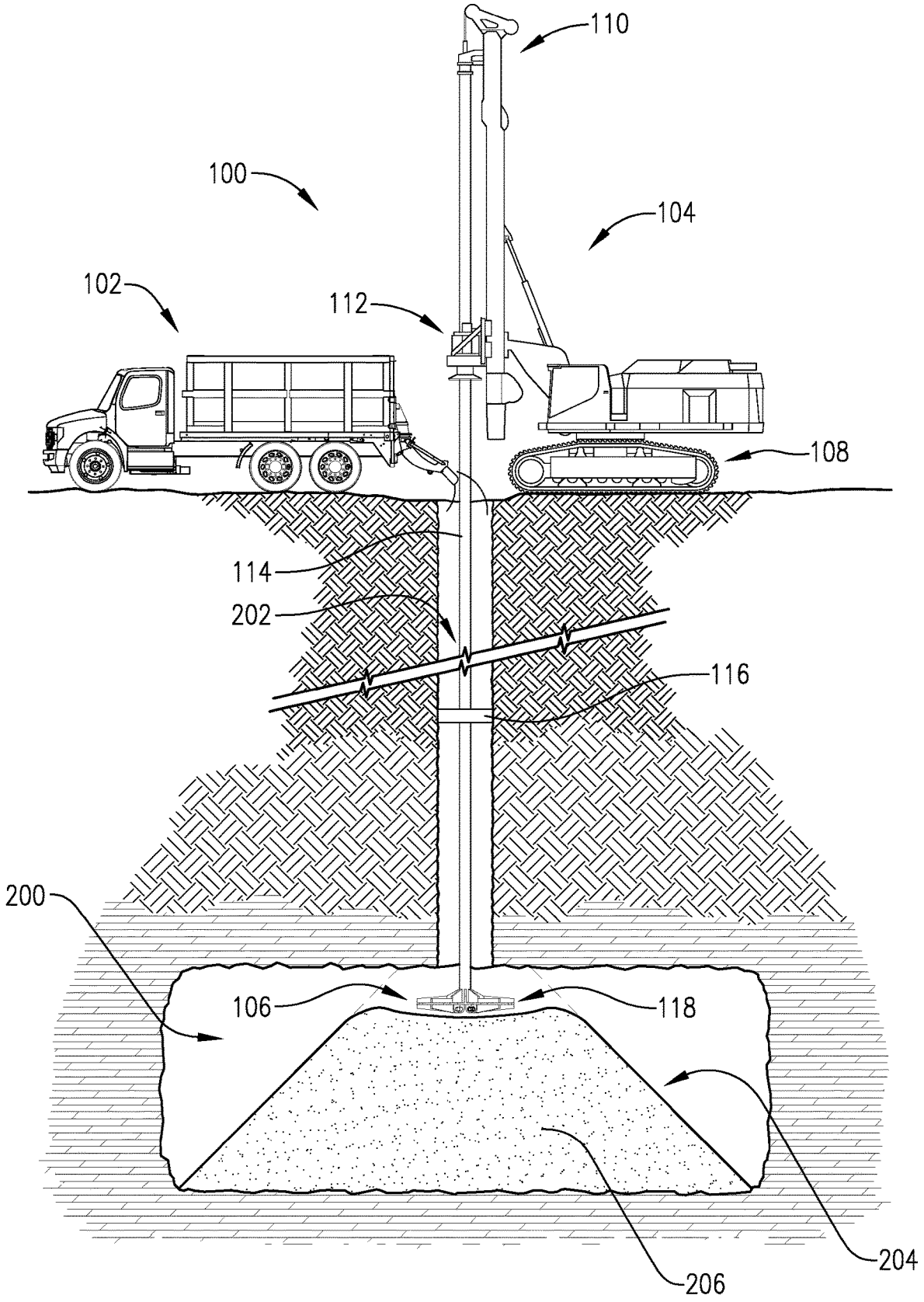
FIG. 1 is an elevation view of a mine stabilization system constructed in accordance with an embodiment of the invention.
Figure 2:
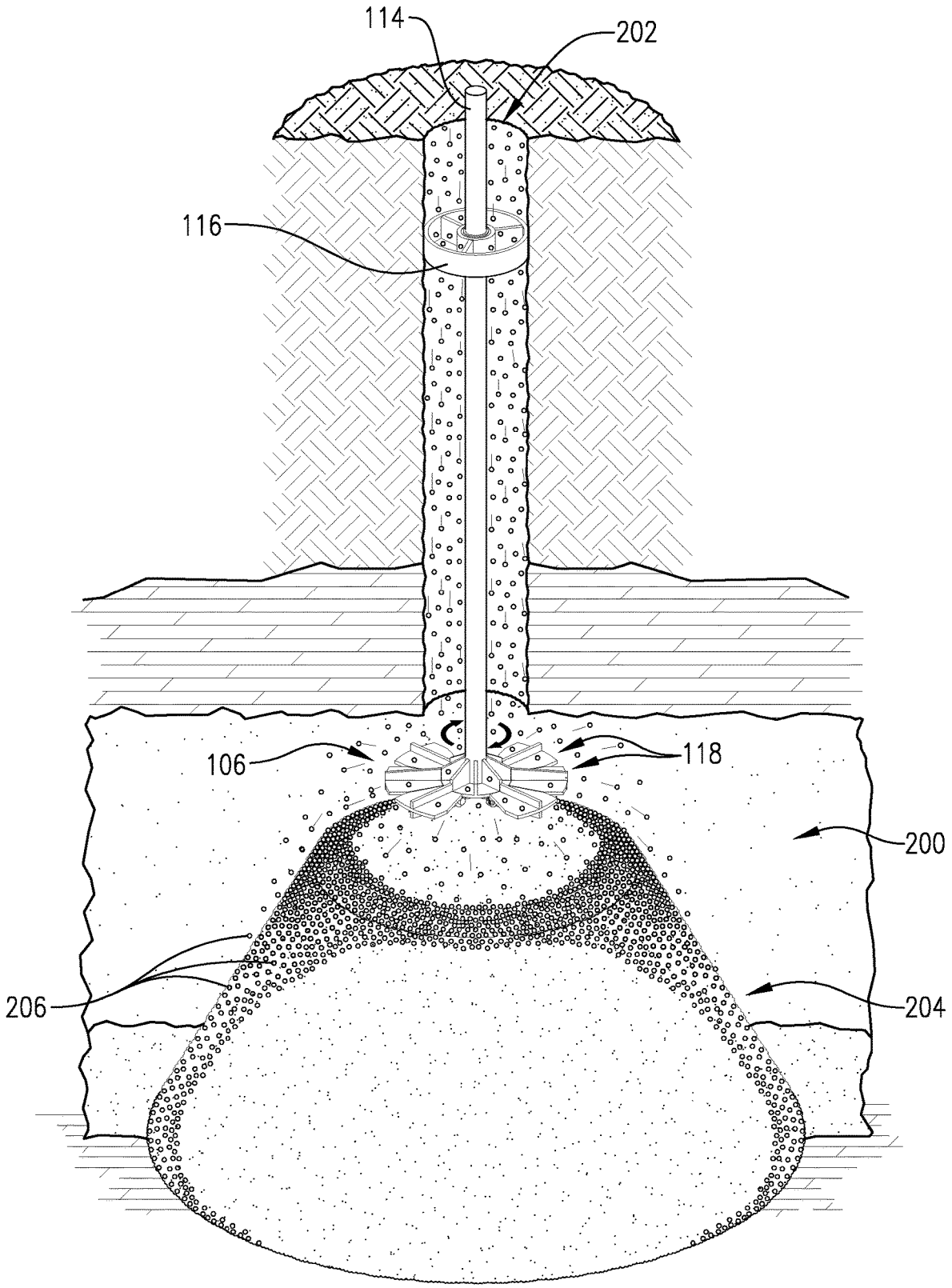
FIG. 2 is a perspective view of an aggregate slinger of the mine stabilization system of FIG. 1.
Figure 3:
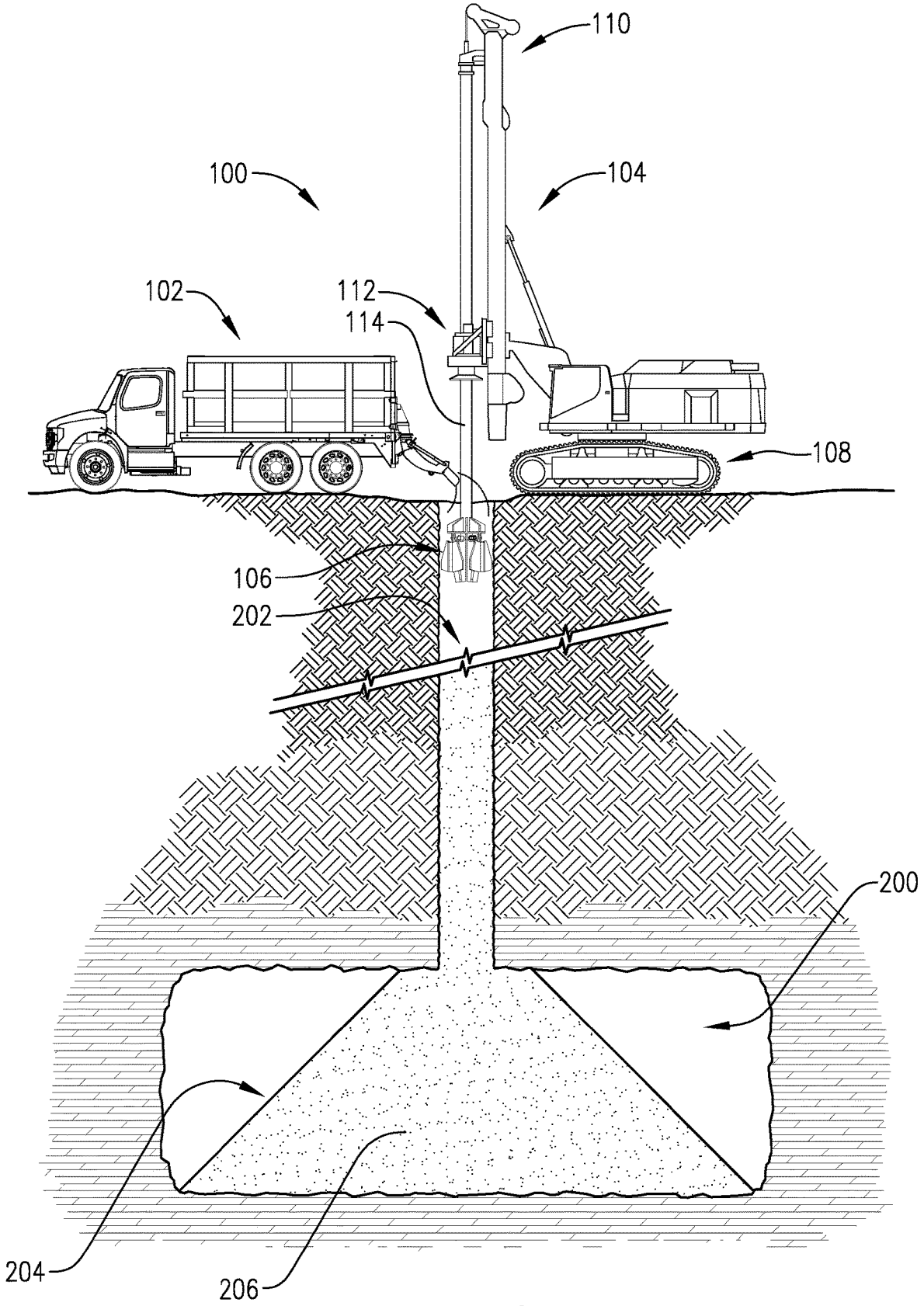
FIG. 3 is another elevation view of the mine stabilization system of FIG. 1.
Figure 4:
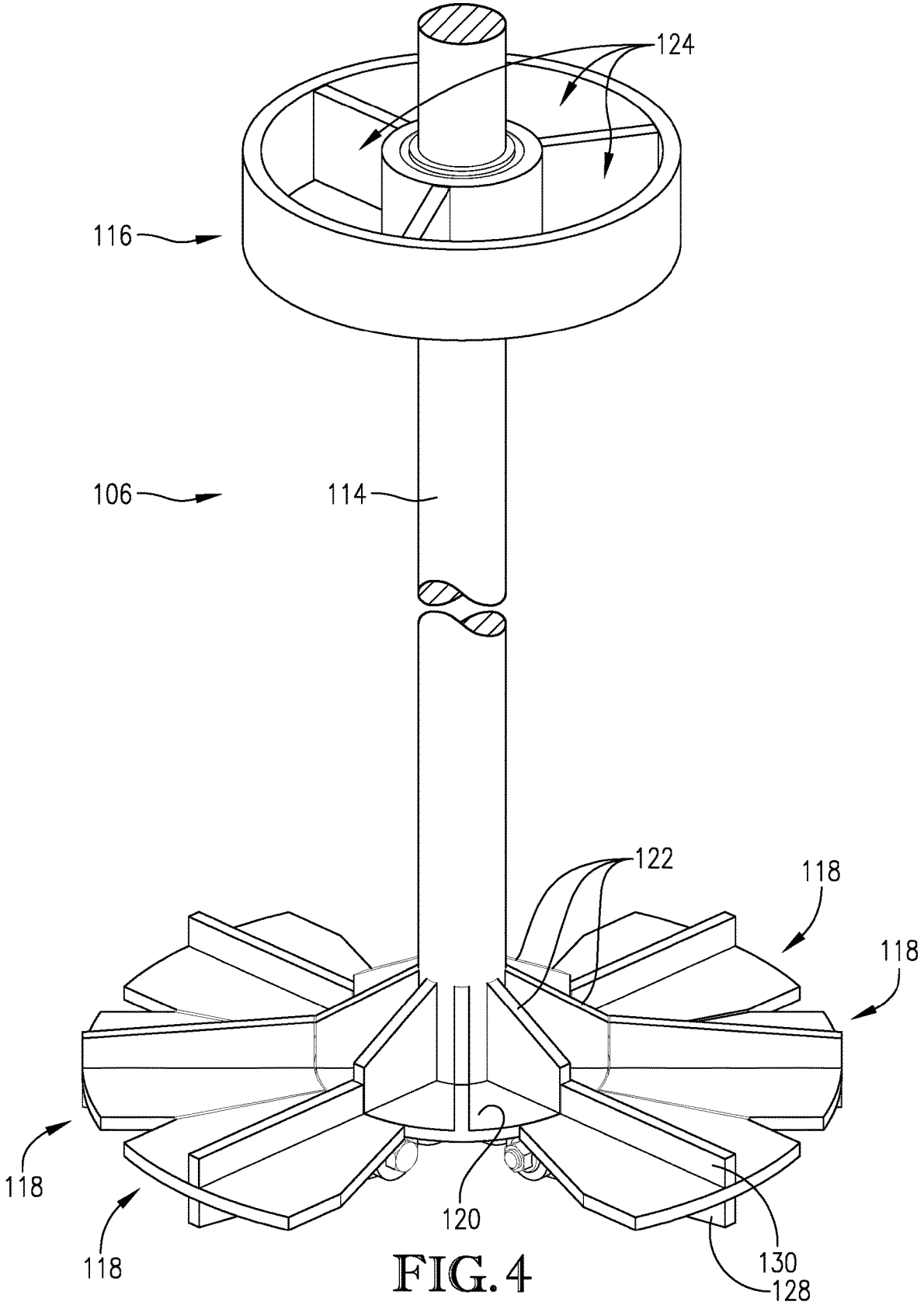
FIG. 4 is an enlarged perspective view of the aggregate slinger of FIG. 2.
Figure 5:
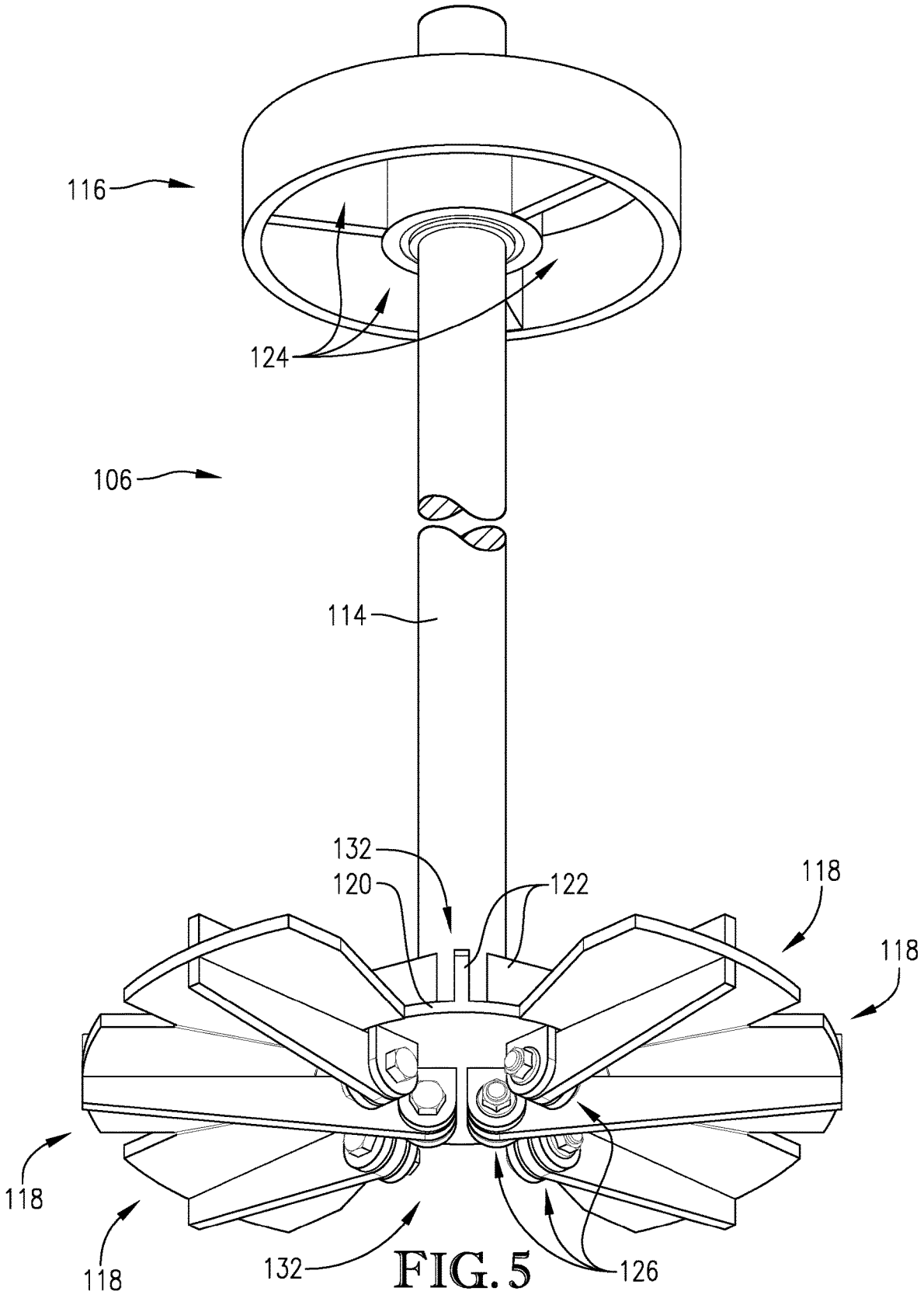
FIG. 5 is an enlarged bottom perspective view of the aggregate slinger of FIG. 2.
Figure 6:
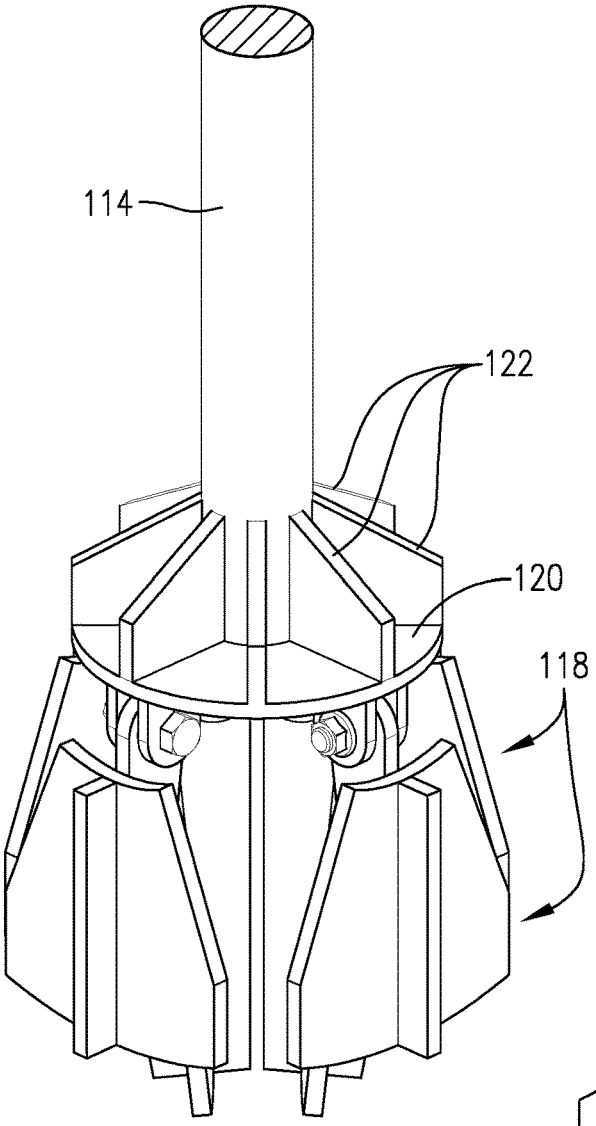
FIG. 6 is an enlarged perspective view of a portion of the aggregate slinger of FIG. 2.
Figure 7:
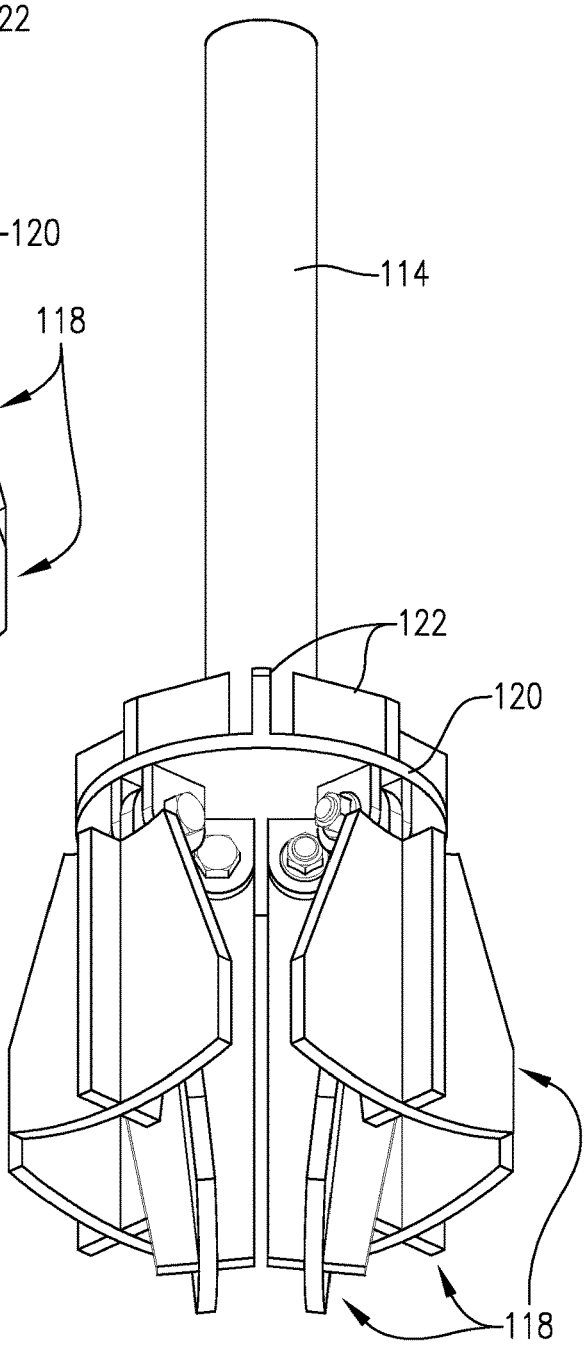
FIG. 7 is an enlarged bottom perspective view of the aggregate slinger of FIG. 2.
Figure 8:
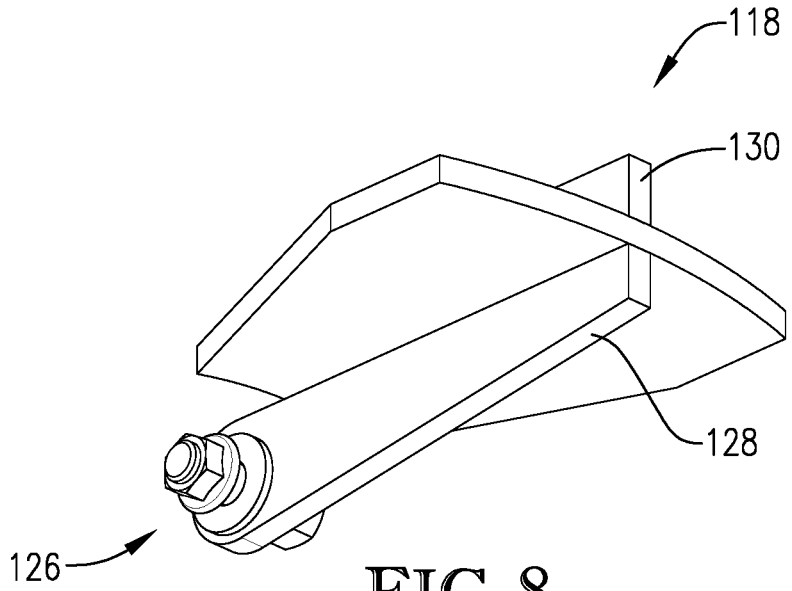
FIG. 8 is a bottom perspective view of a dispersing member of the aggregate slinger of FIG. 2.
Figure 9:
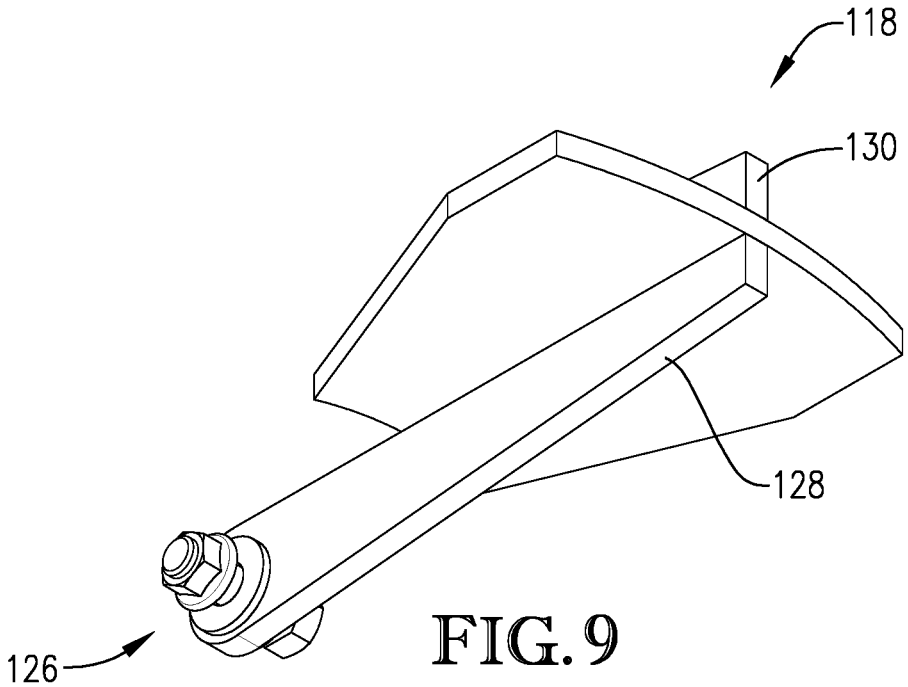
FIG. 9 is a bottom perspective view of another dispersing member of the aggregate slinger of FIG. 2.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

Turning to FIGS. 1-9, an underground void stabilization system, and in particular mine stabilization or karstic features system 100, constructed in accordance with an embodiment of the invention is illustrated. The mine stabilization system 100 broadly comprises an aggregate feeder 102 and a rotary machine 104 including an aggregate slinger 106. The mine stabilization system 100 may be used to reinforce an underground void 200 (e.g., a mine or karst feature) via a ground hole 202 by forming a radially enlarged support column 204.

The aggregate feeder 102 may be a hopper, an auger, a conveyor, a gravity-fed chute, a dump truck, an earthmover such as an excavator or backhoe, or the like. The aggregate feeder 102 may provide a steady or on-demand supply of aggregate 206 (e.g., aggregate rock). To that end, the aggregate feeder 102 may be maneuverable to be feed the aggregate 206 into the ground hole 202. The aggregate 206 may be 2 inch clean crushed rock, ¾ inch clean crushed rock, fine rock dust, or sand. Different grades of aggregate 206 may also be used in progressive stages or in combination.

The aggregate feeder 102 may in turn be supplied with crushed rock via an earthmover such as an excavator or backhoe, a crane, a bulldozer, a gravity feed, a conveyor, or the like. For example, a backhoe may be used to fill a hopper with aggregate 206 from a rock pile as needed. The rock pile may be delivered to the job site or may be crushed on site via a rock crusher.

The rotary machine 104 may include a track 108, a vertical telescoping column 110, a rotary motor 112, and the aforementioned aggregate slinger 106. The rotary machine 104 delivers the aggregate slinger 106 downward through the ground hole 202 into the mine 200 via the vertical telescoping column 110. To that end, the rotary machine 104 may be positioned near the ground hole 202 via the track 108. The rotary motor 112 may be mounted on the vertical telescoping column 110 and drivably connected to the aggregate slinger 106 to rotate the aggregate slinger 106 about its vertical axis. The rotary motor 112 may be chosen according to a desired torque and rotational speed or may have ranges or options of torque and rotational speed to be selected based on the particular aggregate being deposited, moisture levels of the aggregate, the ground, or the atmosphere, ground hole length, development of the support column 204, and other considerations.

With particular reference to FIGS. 5-9, the aggregate slinger 106 may be configured to deposit the aggregate 206 in the void 200 to form the support column 204 and broadly comprises a vertically extending shaft 114, a bearing 116, and a plurality of dispersing members 118. The aggregate slinger 106 may be vertically suspended from the vertical telescoping column 110 and configured to be lowered through the ground hole 202 and at least partially into the void 200.

The vertically extending shaft 114 may be supported on the vertical telescoping column and may include opposing upper and lower ends. The vertically extending shaft 114 may be drivably connected to the rotary motor 112 near the upper end and may be aligned in the ground hole 202 via the bearing 116. The vertically extending shaft 114 may include a flange 120 and a plurality of ribs 122.

The flange 120 supports the ribs 122 and the plurality of dispersing members 118. The plurality of ribs 122 may be spaced around a top side of the flange 120 and oriented radially outwardly. Some of the ribs 122 may align with ribs of the plurality of dispersing members 118. The ribs 122 may be configured to urge aggregate radially outward as the vertically extending shaft 114 rotates.

Alternatively or additionally, the vertically extending shaft 114 may have an outwardly tapered region near the lower end. The outwardly tapered region may serve the same purpose as the flange 120 and ribs 122—to urge aggregate radially outward as the vertically extending shaft 114 rotates.

The bearing 116 may be positioned in the ground hole 202 and configured to receive the vertically extending shaft 114. The bearing 116 may also align and even support the vertically extending shaft in the ground hole 202. To that end, the bearing 116 may include ball bearings, cylindrical bearings, tapered bearings, fluid bearings, or the like. The bearing 116 may be a regular rotary bearing or a thrust bearing, or any other similar bearing. The bearing 116 may include apertures 124 or gaps for allowing aggregate 206 to fall through or around the bearing 116.

The plurality of dispersing members 118 may be pivotably connected to the vertically extending shaft 114 near the lower end via a hinge 126 and shiftable between a retracted position and a deployed position. The plurality of dispersing members 118 may be or may include plates or fins and may each include lower and upper radially extending ribs 128, 130. The lower radially extending rib 128 may be positioned on a bottom side of the plate and may connect the plate to the hinge 126. The upper radially extending rib 128 may be positioned on an upper side of the plate and may be configured to be aligned with one of the ribs 122. Each plate may be narrower near its proximal end and wider near its distal end. In this way, the plates can abut each other in the deployed position and have enough room between each other to shift to the retracted position.

In one embodiment, some of the dispersing members 118 are spaced from each other to form a gap 132. For example, the dispersing members 118 may be arranged in a pattern of three adjacent dispersing members followed by a gap. The gap 132 allows some of the aggregate to fall without being thrown radially outward and allows the plates to be compactly oriented in the retracted position. In the retracted position (achieved when the aggregate slinger 106 is not spinning), the plurality of dispensing members 118 may hang downward. The plurality of dispensing members 118 may extend outward to the deployed position via centrifugal force. The plurality of dispensing members 118 may be confined to a horizontal diameter of a maximum of approximately 11.5 inches in the retracted position and extend to a horizontal diameter of a minimum of approximately 25 inches in the deployed position.

The radially oriented rib 128 may be configured to urge aggregate radially outward as the vertically extending shaft 114 rotates. To that end, the radially oriented rib 128 may align with one of the ribs 122 of the vertically extending shaft 114.

In use, the mine stabilization system 100 may be positioned near ground hole 202 above the void 200 with the vertically extending shaft 114 of the rotary machine 104 aligned with the ground hole 202. The telescoping column 110 may then lower the vertically extending shaft 114 and the aggregate slinger 106 down through the ground hole 202 until the aggregate slinger 106 is inside and near a top of the mine 200. This may include positioning the bearing 116 in the ground hole 202 to laterally stabilize the vertically extending shaft 114. The dispersing members 118 may be in the retracted position so that they fit in the ground hole 202.

The rotary motor 112 may then be activated to spin the aggregate slinger 106. This may force the dispersing members 118 to the deployed position. The aggregate feeder 102 may then dispense aggregate 206 into the ground hole 202. The aggregate 206 may pass through or around the bearing 116 via the apertures 124. Some of the aggregate 206 may then hit the bottom of the aggregate slinger 106. Specifically, some of the aggregate 206 may hit the flange 120 and ribs 122 of the vertically extending shaft 114 and the plates and upper radially extending ribs 130 of the dispersing members 118. The rotation of the aggregate slinger 106 may then force the aggregate 206 radially outward. Some of the aggregate 206 may also fall through the gaps 132. This results in radially enlarged support column 204. In one embodiment, the aggregate slinger 106 may spin at 225 rpms with an aggregate flow rate of one cubic yard per minute.

The rotary motor 112 may then be deactivated to stop the aggregate slinger 106 from spinning. This allows the dispersing members 118 to be urged via gravity to the retracted position. The aggregate slinger 106 may then be raised up through the ground hole 202. The ground hole 202 may then be filled with aggregate 206.

Figure 10:
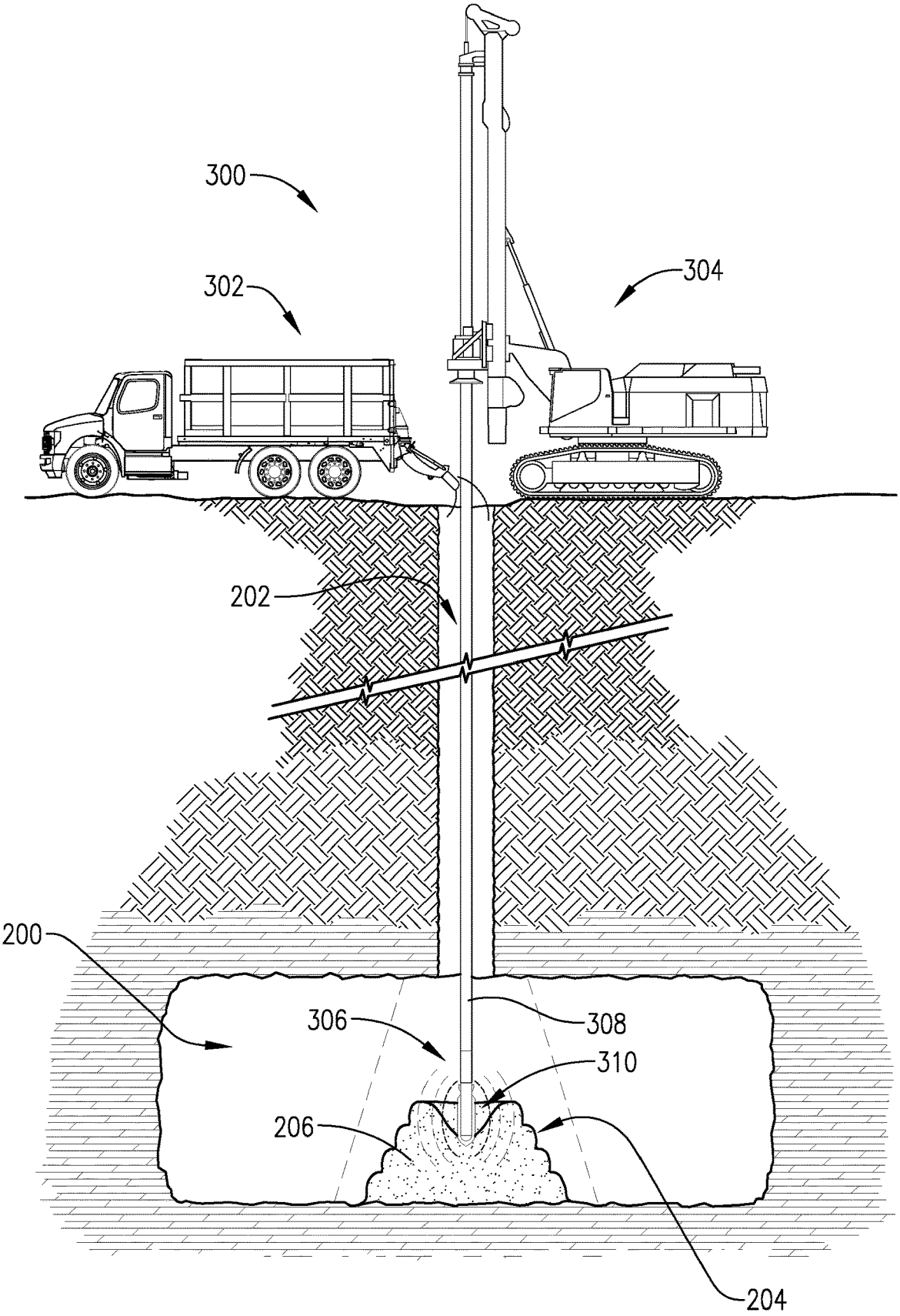
FIG. 10 is an elevation view of a mine stabilization system constructed in accordance with an embodiment of the invention.
Figure 11:
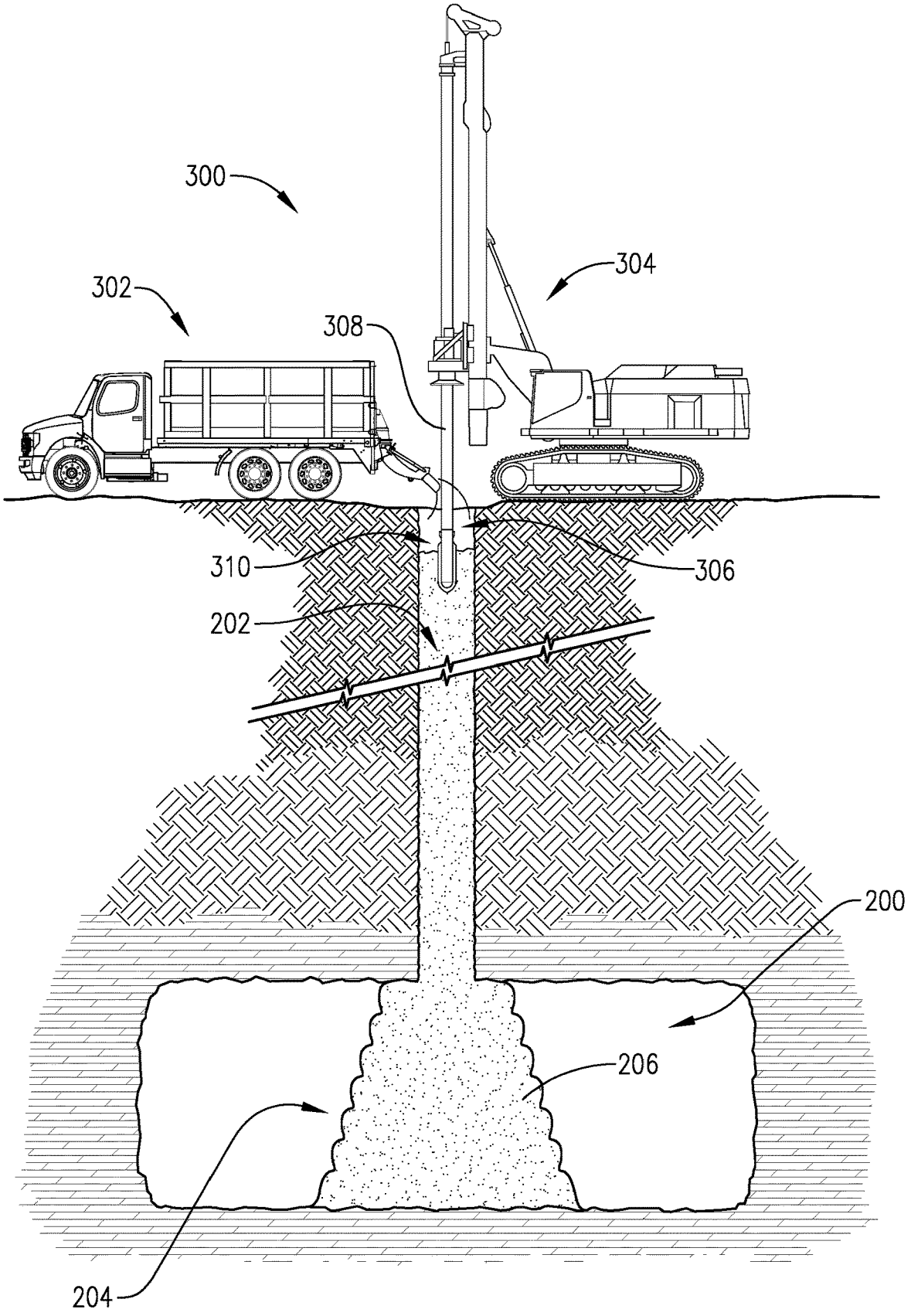
FIG. 11 is another elevation view of the mine stabilization system of FIG. 10.

Turning to FIGS. 10 and 11, a mine stabilization system 300 constructed in accordance with another embodiment of the invention is illustrated. The mine stabilization system 300 broadly comprises an aggregate feeder 302 and a vibroflotation machine 304 including a vibroflotation tool 306. The mine stabilization system 300 may be used to reinforce an underground void such as mine 200 via a ground hole 202 by forming a radially enlarged support column 204.

The aggregate feeder 302 may be a hopper, an auger, a conveyor, a gravity-fed chute, a dump truck, an earthmover such as an excavator or backhoe, or the like. The aggregate feeder 302 may provide a steady or on-demand supply of aggregate 206 (e.g., aggregate rock). To that end, the aggregate feeder 302 may be maneuverable to be feed the aggregate 206 into the ground hole 202. The aggregate 206 may be 2 inch clean crushed rock, ¾ inch clean crushed rock, or fine rock dust. Different grades of aggregate 206 may also be used in progressive stages or in combination.

The aggregate feeder 302 may in turn be supplied with crushed rock via an earthmover such as an excavator or backhoe, a crane, a bulldozer, a gravity feed, a conveyor, or the like. For example, a backhoe may be used to fill a hopper with aggregate 206 from a rock pile as needed. The rock pile may be delivered to the job site or may be crushed on site via a rock crusher.

The vibroflotation machine 304 may include a track, a vertical telescoping column, and the aforementioned vibroflotation tool 306. The vibroflotation machine 304 delivers the vibroflotation tool 306 downward through the ground hole 202 into the mine 200 via the vertical telescoping column. To that end, the vibroflotation machine 304 may be positioned near the ground hole 202 via the track.

The vibroflotation tool 306 may be configured to deposit the aggregate 206 in the mine 200 to form the support column 204 and broadly comprises a vertically extending shaft 308 and a vibroflotation head 310. The vibroflotation tool 306 may be vertically suspended from the vertical telescoping column and configured to be lowered through the ground hole 202 and at least partially into the mine 200.

The vertically extending shaft 308 may be supported on the vertical telescoping column and may include opposing upper and lower ends. The vertically extending shaft 308 may be unsupported laterally so that the vibroflotation head 310 may vibrate freely as discussed below.

The vibroflotation head 310 may be positioned near the lower end of the vertically extending shaft 308 and may include a motor, an eccentric mass, and a waterjet system. The motor may be configured to rotatably drive the eccentric mass. The eccentric mass is drivably connected to the motor and is configured to rotate at high velocity, thereby causing a vibration in the vibroflotation head 310. The waterjet system may be entrained in the vertically extending shaft 308 and the vibroflotation head 310 and configured to deliver high pressure water from the vibroflotation head 310.

In use, the mine stabilization system 300 may be positioned near ground hole 202 above the mine 200 with the vertically extending shaft 308 of the vibroflotation tool 306 aligned with the ground hole 202. The telescoping column may then lower the vibroflotation tool 306 down through the ground hole 202 until the vibroflotation head 310 is near a bottom of the mine 200.

The motor of the vibroflotation tool 306 may then be activated to vibrate the vibroflotation head 310. The aggregate feeder 302 may then dispense aggregate 206 into the ground hole 202. In one embodiment, the aggregate 206 is dispensed into a second ground hole near the ground hole 202. The aggregate 206 may then accumulate around the vibroflotation head 310. The waterjet system may also disperse water into the aggregate 206. The vibration of the vibroflotation head 310 and the water may then spread the aggregate 206 outward but also pack the aggregate 206 to form a dense, radially enlarged support column 204. Use of the vibroflotation tool 306 may work well in a partially flooded underground void such that the aggregate is inundated in water.

The vibroflotation tool 306 may then be gradually raised upward through the ground hole 202 as aggregate 206 is dropped into the ground hole 202. Continued vibration of the vibroflotation head 310 and water dispersement causes aggregate to densely pack the ground hole 202.

The vibroflotation tool 306 may finally be raised out of the ground hole 202, and the motor of the vibroflotation tool 306 may be deactivated to stop the vibroflotation head 310 from vibrating. The waterjet system may also be deactivated to stop the flow of water.

Figure 12:
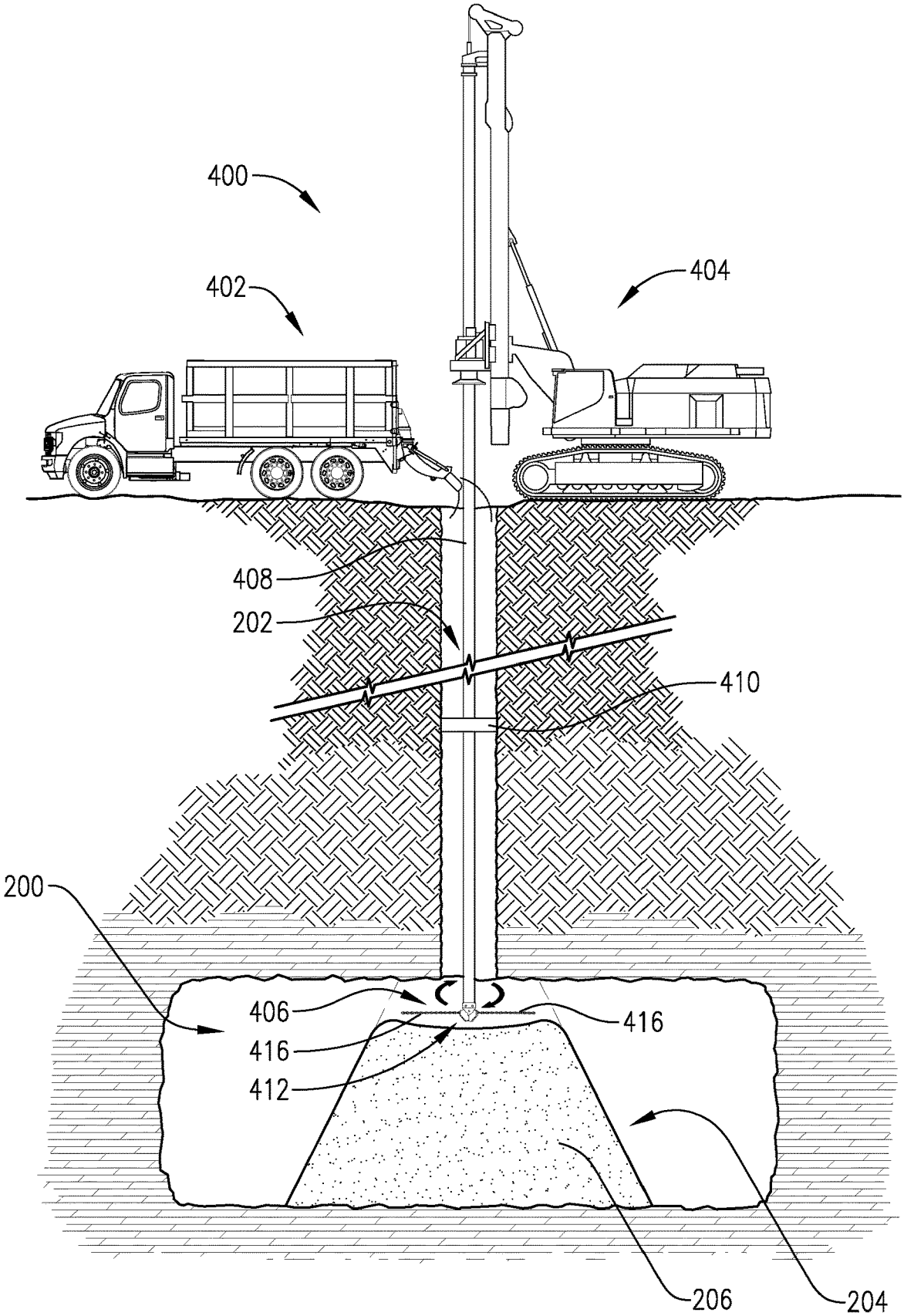
FIG. 12 is an elevation view of a mine stabilization system constructed in accordance with another embodiment of the invention.
Figure 13:
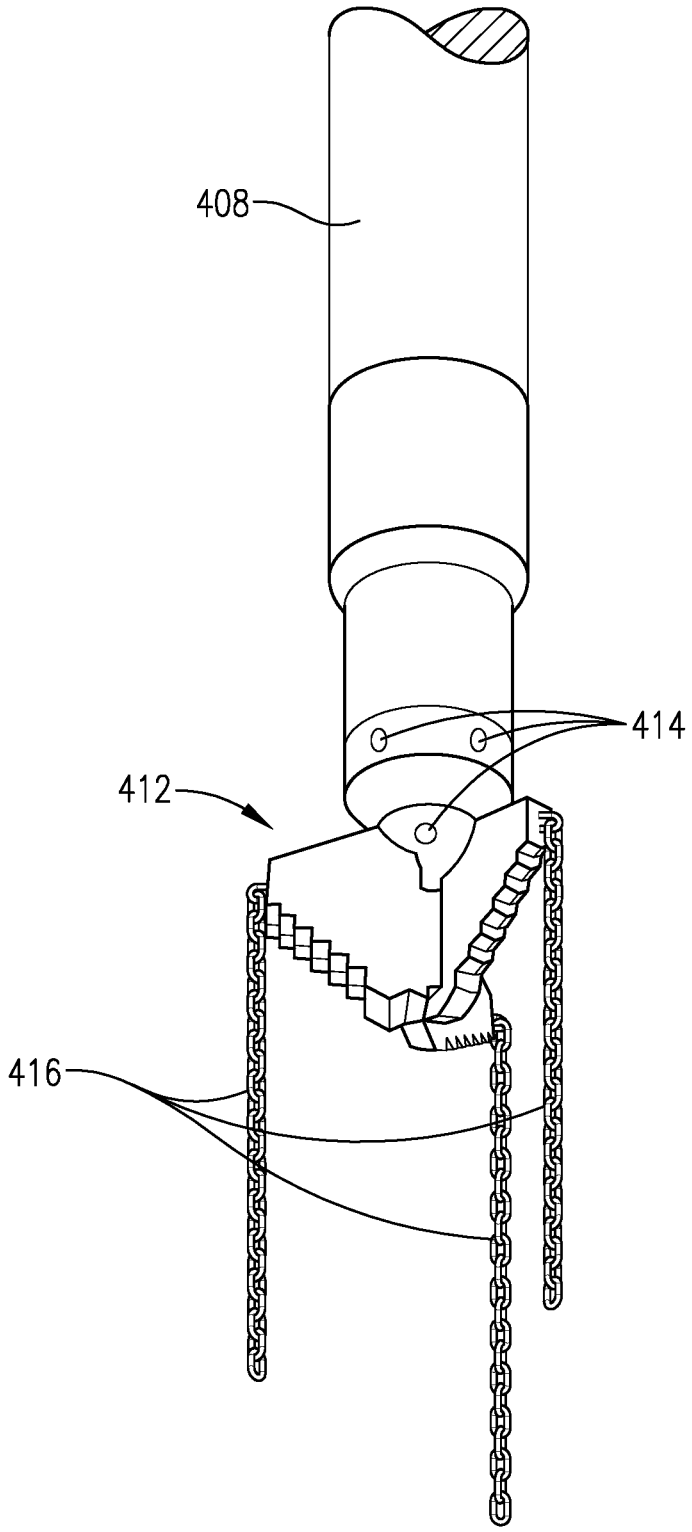
FIG. 13 is an enlarged bottom perspective view of an aggregate slinger of the mine stabilization system of FIG. 12.

Turning to FIGS. 12 and 13, a mine stabilization system 400 constructed in accordance with an embodiment of the invention is illustrated. The mine stabilization system 400 broadly comprises an aggregate feeder 402 and a rotary machine 404 including an aggregate slinger 406. The mine stabilization system 400 may be used to reinforce an underground void such as mine 200 via a ground hole 202 by forming a radially enlarged support column 204.

The aggregate feeder 402 may be a hopper, an auger, a conveyor, a gravity-fed chute, a dump truck, an earthmover such as an excavator or backhoe, or the like. The aggregate feeder 402 may provide a steady or on-demand supply of aggregate 206 (e.g., aggregate rock). To that end, the aggregate feeder 402 may be maneuverable to be feed the aggregate 206 into the ground hole 202. The aggregate 206 may be 2 inch clean crushed rock, ¾ inch clean crushed rock, or fine rock dust. Different grades of aggregate 206 may also be used in progressive stages or in combination.

The aggregate feeder 402 may in turn be supplied with crushed rock via an earthmover such as an excavator or backhoe, a crane, a bulldozer, a gravity feed, a conveyor, or the like. For example, a backhoe may be used to fill a hopper with aggregate 206 from a rock pile as needed. The rock pile may be delivered to the job site or may be crushed on site via a rock crusher.

The rotary machine 404 may include a track, a vertical telescoping column, a rotary motor, and the aforementioned aggregate slinger 406. The rotary machine 404 delivers the aggregate slinger 406 downward through the ground hole 202 into the mine 200 via the vertical telescoping column. To that end, the rotary machine 404 may be positioned near the ground hole 202 via the track. The rotary motor may be mounted on the vertical telescoping column and drivably connected to the aggregate slinger 406 to rotate the aggregate slinger 406 about its vertical axis. The rotary motor may be chosen according to a desired torque and rotational speed or may have ranges or options of torque and rotational speed to be selected based on the particular aggregate being deposited, moisture levels of the aggregate, the ground, or the atmosphere, ground hole length, development of the support column 204, and other considerations.

With particular reference to FIG. 13, the aggregate slinger 406 may be configured to deposit the aggregate 206 in the mine 200 to form the support column 204 and broadly comprises a vertically extending shaft 408, a bearing 410, and a rotary head 412. The aggregate slinger 406 may be vertically suspended from the vertical telescoping column and configured to be lowered through the ground hole 202 and at least partially into the mine 200.

The vertically extending shaft 408 may be supported on the vertical telescoping column and may include opposing upper and lower ends. The vertically extending shaft 408 may be drivably connected to the rotary motor near the upper end and may be aligned in the ground hole 202 via the bearing 410.

The bearing 410 may be positioned in the ground hole 202 and configured to receive the vertically extending shaft 408. The bearing 410 may also align and even support the vertically extending shaft in the ground hole 202. To that end, the bearing 410 may include ball bearings, cylindrical bearings, tapered bearings, fluid bearings, or the like. The bearing 410 may be a regular rotary bearing or a thrust bearing, or any other similar bearing. The bearing 410 may include apertures 124 or gaps for allowing aggregate 206 to fall through or around the bearing 410.

The rotary head 412 includes pneumatic apertures 414 and dispersing links 416. The rotary head 412 may also be a bit having teeth for drilling the ground hole 202 as shown in FIG. 13. Alternatively, the rotary head 412 may be a toothless head to which the dispersing links 416 are attached.

The pneumatic apertures 414 may be positioned around the rotary head 412 for releasing pressurized gas (e.g., pressurized air) radially outward. To that end, the pneumatic apertures 414 may be fluidly linked to a pneumatic system configured to be extended down through the ground hole 202 and activated to release the pressurized gas from the pneumatic apertures 414.

The dispersing links 416 may be chains, cables, wire, or the like connected at one end to a rotating body of the rotary head 412. The dispersing links 416 may be configured to hang downward when the rotary head 412 is not spinning and extend radially outward due to centrifugal force when the rotary head 412 is spinning.

In use, the drill head 412 may be used to create ground hole 202. Alternatively, if the ground hole 202 is already formed, the mine stabilization system 400 may be positioned near ground hole 202 above the mine 200 with the vertically extending shaft 408 of the rotary machine 404 aligned with the ground hole 202. The telescoping column may then lower the vertically extending shaft 408 and the drill tool 406 down through the ground hole 202 until the aggregate slinger is inside and near a top of the mine 200. This may include positioning the bearing 410 in the ground hole 202 to laterally stabilize the vertically extending shaft 408. The dispersing links 416 may be hanging down so that they fit in the ground hole 202.

The rotary motor may then be activated to spin the drill head 412. This may force the dispersing links 416 to extend radially outward. Pressurized gas or fluid may then be released out of the apertures 414. The aggregate feeder 402 may then dispense aggregate 206 into the ground hole 202. The aggregate 206 may pass through or around the bearing 410. Some of the aggregate 206 may then hit the dispersing links 410, thereby forcing the aggregate 206 radially outward. The pressurized gas or fluid released from the apertures 414 may also force the aggregate 206 radially outward. Some of the aggregate 206 may also fall between the dispersing links 410. This results in radially enlarged support column 204.

The rotary motor may then be deactivated to stop the drill head 412 from spinning. This allows the dispersing links 416 to hang downward via gravity. The pressurized gas or fluid may also be deactivated. The drill head 412 may then be raised up through the ground hole 202. The ground hole 202 may then be filled with aggregate 206.

Additional Considerations

The description and drawings are illustrative and are not to be construed as limiting. Numerous specific details are described to provide a thorough understanding. However, in certain instances, well-known or conventional details are not described in order to avoid obscuring the description. References to one embodiment or an embodiment in the present disclosure are not necessarily references to the same embodiment; and, such references mean at least one.

The use of headings herein is merely provided for ease of reference, and shall not be interpreted in any way to limit this disclosure or the following claims.

References to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, and are not necessarily all referring to separate or alternative embodiments mutually exclusive of other embodiments. Moreover, various features are described which may be exhibited by one embodiment and not by others. Similarly, various requirements are described which may be requirements for one embodiment but not for other embodiments. Unless excluded by explicit description and/or apparent incompatibility, any combination of various features described in this description is also included here.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

Although the invention has been described with reference to the embodiments illustrated in the attached drawing figures, it is noted that equivalents may be employed and substitutions made herein without departing from the scope of the invention as recited in the claims.

The invention claimed is:

1. An aggregate slinger for an underground void stabilization system, the aggregate slinger comprising:

a vertically extending shaft configured to be inserted through a ground hole into an underground void and rotate about a vertical axis in the ground hole, the vertically extending shaft including opposing upper and lower ends; and a plurality of members configured to extend radially from the lower end of the vertically extending shaft in the underground void so that the plurality of members radially spread aggregate descending into the underground void from the ground hole to form a radially enlarged support column of aggregate in the underground void, wherein the plurality of members are circumferentially spaced unevenly around the vertical axis.

2. The aggregate slinger of claim 1, each of the plurality of members being shiftable between a retracted position for lowering the plurality of members through the ground hole and a deployed position for radially spreading the aggregate.

3. The aggregate slinger of claim 2, the plurality of members being pivotable between the retracted position and the deployed position.

4. The aggregate slinger of claim 2, the plurality of members being configured to be urged to the retracted position via gravity.

5. The aggregate slinger of claim 2, the plurality of members being configured to be urged to the deployed position via centrifugal force when the vertically extending shaft rotates.

6. The aggregate slinger of claim 2, the plurality of members being arranged in a pattern including gaps between some of the plurality of members to allow the plurality of members to shift to the retracted position and to allow some of the aggregate to pass through the gaps when the plurality of members are in the deployed position.

7. The aggregate slinger of claim 1, the lower end of the vertically extending shaft having a flange and a plurality of ribs configured to urge some of the aggregate radially outward toward the plurality of members.

8. The aggregate slinger of claim 1, the plurality of members being confined to a horizontal diameter of a maximum of 11.5 inches in the retracted position and extending to a horizontal diameter of a minimum of 25 inches in the deployed position.

9. The aggregate slinger of claim 1, wherein each of the plurality of members includes a plate.

10. The aggregate slinger of claim 9, each plate including a rib configured to direct the aggregate radially outward.

11. The aggregate slinger of claim 1, wherein some of the members are longer than other members.

12. The aggregate slinger of claim 1, wherein some of the members are directly or indirectly connected to the vertically extending shaft closer to the vertical axis than other members.

13. The aggregate slinger of claim 1, wherein the plurality of members includes two groups of three members positioned closely together.

14. The aggregate slinger of claim 13, wherein a middle member of the three members is longer than the other two members of the three members.

15. The aggregate slinger of claim 13, wherein a middle member of the three members is directly or indirectly connected to the vertically extending shaft closer to the vertical axis than the other two members of the three members.

16. An aggregate slinger for an underground void stabilization system, the aggregate slinger comprising:

a vertically extending shaft configured to be inserted through a ground hole into an underground void and rotate about a vertical axis in the ground hole, the vertically extending shaft including opposing upper and lower ends;

a plurality of members configured to extend radially from the lower end of the vertically extending shaft in the underground void so that the plurality of members radially spread aggregate descending into the underground void from the ground hole to form a radially enlarged support column of aggregate in the underground void; and a bearing configured to be positioned in the ground hole such that the vertically extending shaft is aligned in the ground hole via the bearing, wherein the bearing includes a plurality of apertures for the aggregate to pass therethrough.

17. An aggregate slinger for an underground void stabilization system, the aggregate slinger comprising:

a vertically extending shaft configured to be inserted through a ground hole into an underground void and rotate about a vertical axis in the ground hole, the vertically extending shaft including opposing upper and lower ends; and a plurality of members configured to extend radially from the lower end of the vertically extending shaft in the underground void so that the plurality of members radially spread aggregate descending into the underground void from the ground hole to form a radially enlarged support column of aggregate in the underground void, wherein each of the plurality of members is shiftable between a retracted position for lowering the plurality of members through the ground hole and a deployed position for radially spreading the aggregate, and wherein each of the plurality of members includes a plate oriented substantially horizontally when the member is in the deployed position.

18. The aggregate slinger of claim 17, wherein the plates are wedge-shaped.

19. The aggregate slinger of claim 17, wherein each of the plurality of members includes a rib extending vertically when the member is in the deployed position.

* * * * *